United States Patent [19]

Seidler

[11] 4,184,499

[45] Jan. 22, 1980

[54] DEVICES WITH TWO WORKING SURFACES

[75] Inventor: David Seidler, Forest Hills, N.Y.

[73] Assignee: Revlon, Inc., New York, N.Y.

[21] Appl. No.: 855,422

[22] Filed: Nov. 28, 1977

[51] Int. Cl.[2] ..... A45D 29/04
[52] U.S. Cl. ..... 132/75.6
[58] Field of Search ..... 132/88.7, 75.6, 76.2, 132/76.4, 5

[56] References Cited

U.S. PATENT DOCUMENTS

| | | | |
|---|---|---|---|
| 811,992 | 2/1906 | Angus et al. | 132/75.6 |
| 1,014,629 | 1/1912 | Mendelsohn | 132/76.5 X |
| 1,868,985 | 7/1932 | Lyon | 132/76.2 X |
| 2,323,595 | 7/1943 | Hanisch | 132/88.7 |
| 2,376,946 | 5/1945 | Stinson | 132/76.5 |

*Primary Examiner*—G. E. McNeill
*Attorney, Agent, or Firm*—Leon E. Tenenbaum

[57] ABSTRACT

A device which has two (2) working surfaces for use as applicators, buffers, or massagers, and a pair of opposed reversible handles.

2 Claims, 8 Drawing Figures

DEVICES WITH TWO WORKING SURFACES

BACKGROUND OF THE INVENTION

The present invention relates to a holding device. It particularly relates to a holding device for applicators, nail buffers, massagers and the like, having two (2) separate working surfaces.

In manicuring, the nails are buffed to provide them with a proper gloss. Preferably, the buffing operation is carried out by employing different polishing materials successively, starting with a comparatively coarse, abrading surface and finishing with a smooth surface. In practice, it has been found convenient and satisfactory to use two (2) buffing surfaces-one being finer than the other.

While individual buffing implements, each provided with a buffing element having a surface of a different degree of fineness can be used, this practice has proven to be inconvenient, and various devices have been developed to provide buffing implements having more than one (1) buffing surface or means for providing different buffing surfaces on the same implement. Such implements are described in U.S. Pat. Nos. 811,992; 893,004; 1,014,629; 1,134,088 and 3,706,316.

The 893,004 describes an implement whose opposing sides contain buffing cloths of different degrees of fineness. The implement is flexible and is inconvenient to use.

The U.S. Pat. No. 3,706,316 describes an implement which can be disassembled and then reassembled to remove one buffing cloth and insert another.

The other patents show implements having two (2) separate buffing surfaces. These implements, however, require removal of and reinsertion of the handle when the user wishes to change from one buffing surface to another. Needless to say, this is inconvenient for the user.

It is an object of this invention to provide an improved buffing device wherein the disadvantages of the prior devices are avoided.

It is another object of this invention to provide an improved buffing device having two (2) buffing elements each of whose surfaces is of a different degree of fineness, which does not require removing or disassembling and reinserting or reassembling of components for use of the individual buffing surfaces.

It is a further object of this invention to provide an improved buffing device wherein the buffing surfaces are substantially rigidly supported.

Other features and advantages of this invention will be apparent from the specification and drawings.

DESCRIPTION OF THE DRAWINGS

There is shown in the attached drawings a preferred embodiment of this invention, wherein.

Figure 1:
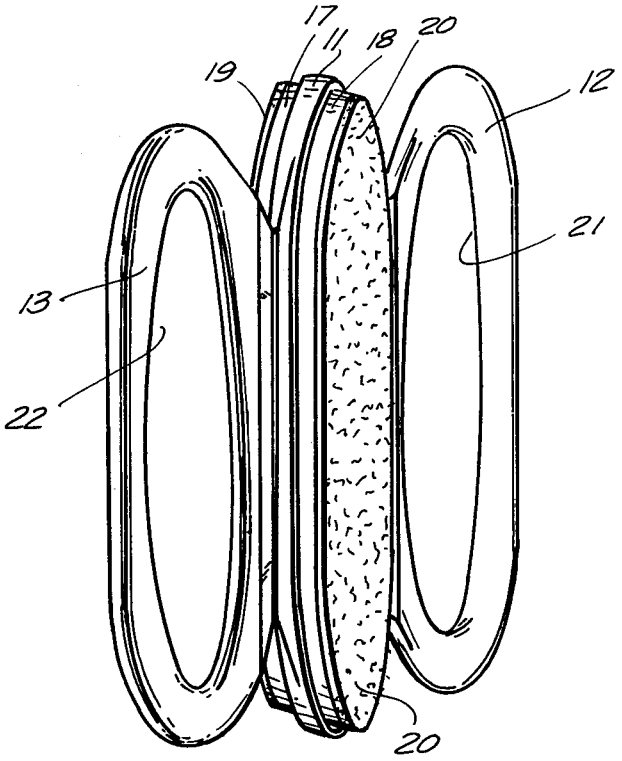
FIG. 1 is a front perspective view of the buffing device.
Figure 2:
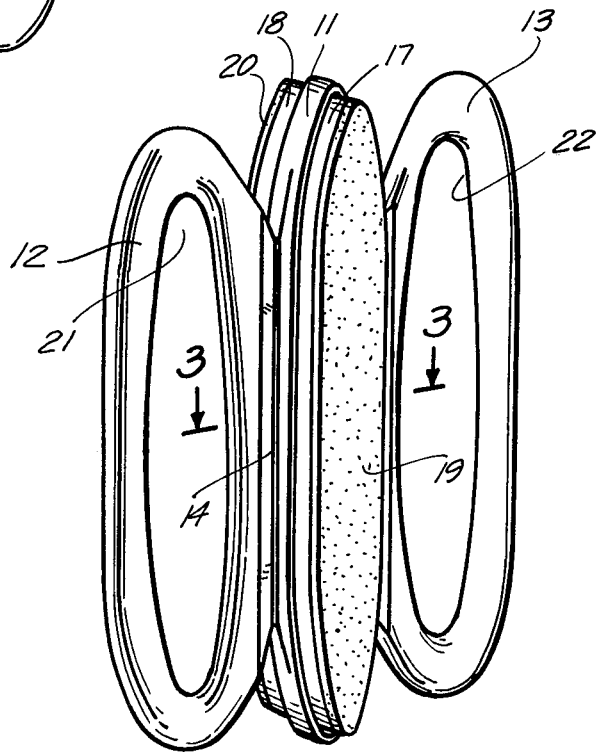
FIG. 2 is a rear perspective view of the buffing device
Figure 3:
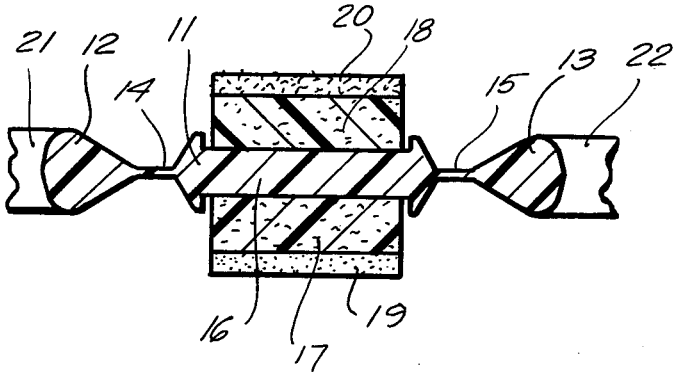
FIG. 3 is a partial sectional view along the line 3—3 of FIG. 2.
Figure 5:
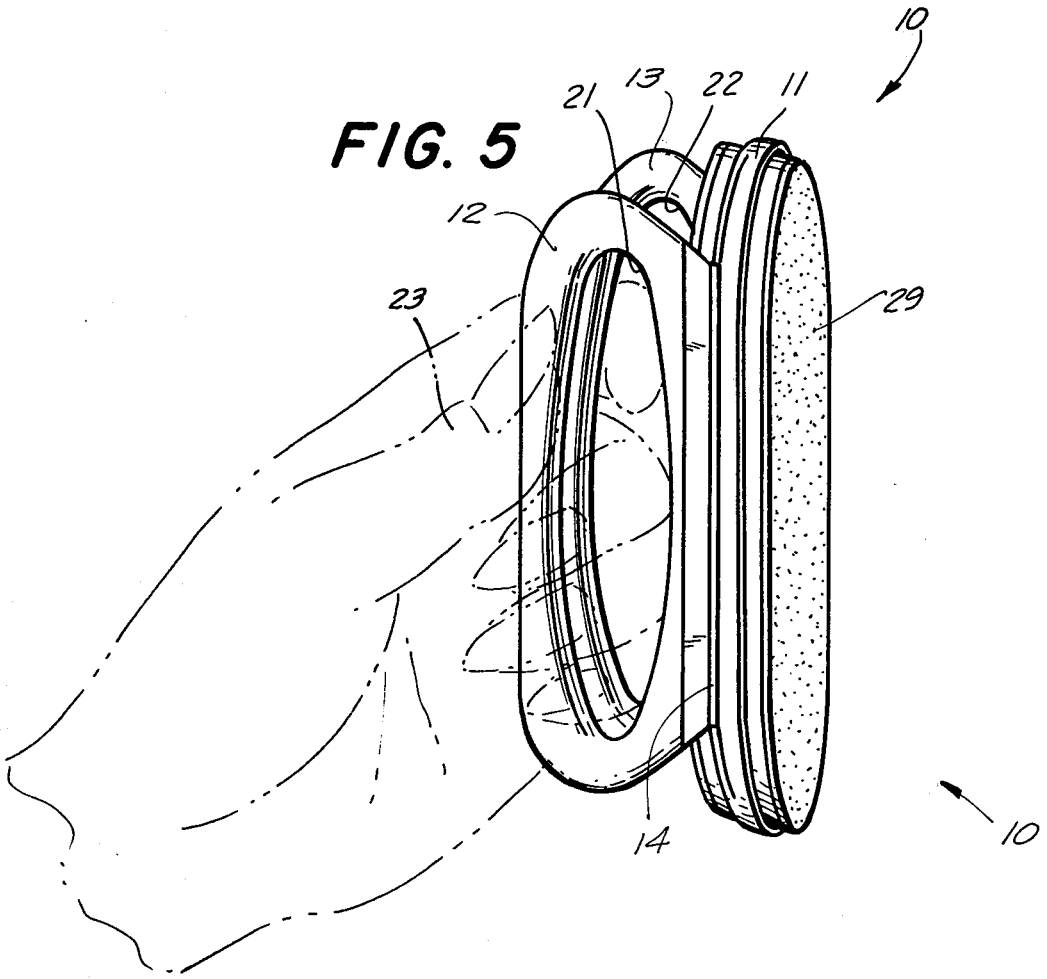
FIG. 5 is a perspective view of the buffing device being held in the hand of the user.
Figure 4:
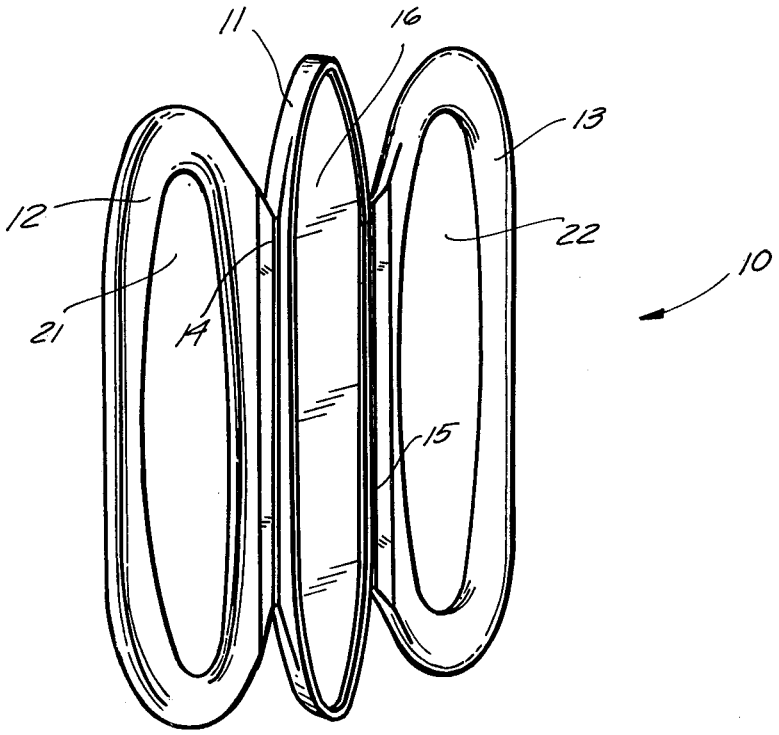
FIG. 4 is a perspective view of the buffing device from which the buffing elements and their supports have been removed.

Referring to drawings, a buffing device constituting one embodiment of the present invention generally designated 10, comprises a frame 11, to which are integrally attached opposing handles 12, 13 along living, reversible hinges 14, 15. Within the frame and integrally attached thereto is a backing element 16, to each side of which are secured by pressure sensitive adhesives or other suitable means supporting elements 17, 18, on which are placed buffing materials 19, 20 having different degrees of fineness. The handles are preferably provided with cutouts 21, 22, for insertion of the fingers 23, of the user. Either on or both buffing materials may be replaced by applicator or massage materials such as felt, sponge or molded scrubbing or massage materials.

Figure 6:
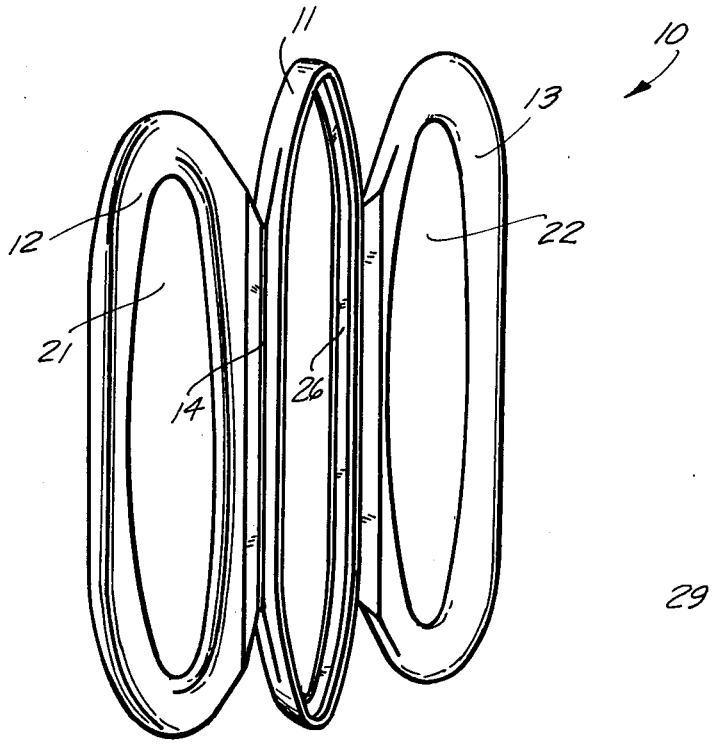
FIG. 6 is a partial perspective view of the frame portion of the device, from which the backing element has been removed.
Figure 7:
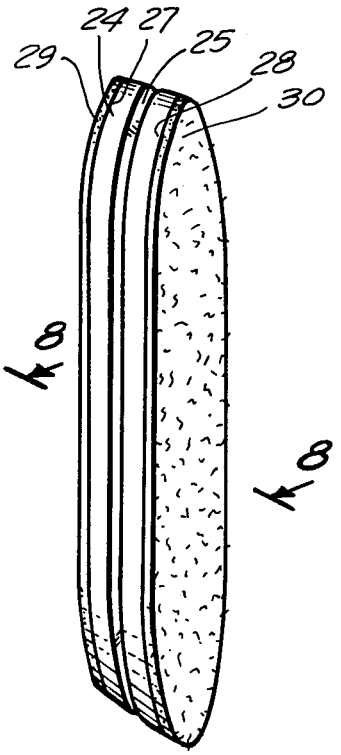
FIG. 7 is a perspective view of a support which serves to hold two (2) buffing elements.
Figure 8:
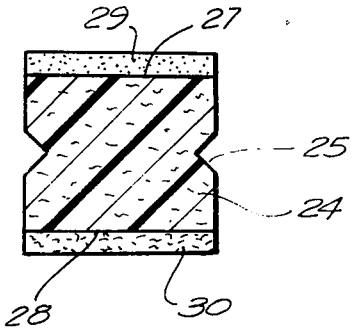
FIG. 8 is a sectional view along the line 8—8 of FIG. 7.

In a modification, as shown in FIG. 6–8, the backing element of the frame is absent and the supporting element 24 is held within an open frame in firm relation thereto. Preferably, this supporting element 24, is somewhat more rigid than the supporting elements 17 and 18, and is provided with a circumferential groove 25 which engages a circumferential projecting element 26 on the inside of the frame. On the opposing faces 27, 28 of the supporting element 24 are placed buffing materials 29, 30.

The frame, the backing element and the opposing handles are molded of structured polypropylene. However, any material having flexibility but some modicum of rigidity may be used. Other such suitable materials are structured foam polyethylene, nylon, polyurethane and flexible hard rubbers. The supporting element is preferably constructed of polyurethane but any similar material having flexibility and a modicum of rigidity may be used. The buffing or applicator materials are sealed to the housing by glue or other suitable sealing means. The buffers are comprised of materials of different degrees of fineness. In the preferred embodiment, one buffing material is a chamois and the other is a cotton velour, but other suitable buffing materials may be used.

The living, reversible hinge is constructed to provide a degree of rotation of over 180°. When the handles are gripped and bent back or when the fingers are first inserted in the cutouts or openings and the handles gripped and bent back a secure hold is achieved. By reversing the rotation of the handles, the other buffing surface can be exposed.

When not in use, the device lies flat and can be packaged without difficulty.

When used to hold nail buffers, the frame is preferably elongated, but it can be made into any desired shape.

I claim:

1. A device for use as a buffer, massager or applicator comprising a frame to which are integrally attached opposing handles along living, reversible hinges, a backing element inside said frame and integrally attached thereto, a pair of supporting elements on each side of the backing element and secured thereto, and, a buffing, massaging or applicator material covering each backing element.

2. A device for use as a buffer or applicator comprising an open frame to which are integrally attached a pair of opposing handles along living, reversible hinges, said frame housing in firm relation thereto a support having a pair of opposing faces, each face having secured thereto a buffing or applicator materi

* * * * *